US008043168B2

(12) United States Patent
Isogawa et al.

(10) Patent No.: US 8,043,168 B2
(45) Date of Patent: Oct. 25, 2011

(54) GOLF BALL

(75) Inventors: Kazuhiko Isogawa, Kobe (JP); Tsutomu Hirau, Kobe (JP)

(73) Assignee: SRI Sports Limited, Kobe (JP)

( * ) Notice: Subject to any disclaimer, the term of this patent is extended or adjusted under 35 U.S.C. 154(b) by 219 days.

(21) Appl. No.: 12/466,123

(22) Filed: May 14, 2009

(65) Prior Publication Data

US 2009/0312121 A1 Dec. 17, 2009

(30) Foreign Application Priority Data

Jun. 13, 2008 (JP) ..... 2008-154893

(51) Int. Cl.
*A63B 37/06* (2006.01)

(52) U.S. Cl. ..... 473/373

(58) Field of Classification Search ..... 473/373, 473/374

See application file for complete search history.

(56) References Cited

U.S. PATENT DOCUMENTS

| | | | | |
|---|---|---|---|---|
| 5,553,852 | A | 9/1996 | Higuchi et al. | |
| 5,830,085 | A | 11/1998 | Higuchi et al. | |
| 6,129,640 | A | 10/2000 | Higuchi et al. | |
| 6,299,551 | B1 * | 10/2001 | Higuchi et al. | 473/374 |
| 2006/0211517 | A1 * | 9/2006 | Isogawa et al. | 473/371 |

* cited by examiner

*Primary Examiner* — Raeann Gorden

(74) *Attorney, Agent, or Firm* — Birch, Stewart, Kolasch & Birch, LLP

(57) ABSTRACT

Golf ball 2 has a center 8, a mid layer 10 and a cover 6. The base polymer of the mid layer 10 includes an ionomer resin as a principal component. The surface hardness H1*s* of the center 8 is greater than the hardness H2 of the mid layer 10. The Shore D hardness H3 of the cover 6 is equal to or greater than 57. The weight W2 of the mid layer 10 is greater than the weight W3 of the cover 6. The total weight (W2+W3) of the weight W2 of the mid layer 10 and the weight W3 of the cover 6 is 8.4 g or greater and less than 12.0 g. The total volume (V2+V3) of the volume V2 of the mid layer 10 and the volume V3 of the cover 6 is equal to or less than 10.0 $cm^3$.

8 Claims, 1 Drawing Sheet

GOLF BALL

This application claims priority on Patent Application No. 2008-154893 filed in JAPAN on Jun. 13, 2008. The entire contents of this Japanese Patent Application are hereby incorporated by reference.

BACKGROUND OF THE INVENTION

1. Field of the Invention

The present invention relates to golf balls. More particularly, the present invention relates to multi-piece golf balls having a center, a mid layer and a cover.

2. Description of the Related Art

Golf balls make a flight with accompanying back spin. Top concern to golf players for golf balls is their flight performances. The flight performance correlates with back spin rate. The flight with small spin rate results in an appropriate trajectory, whereby a great flight distance can be achieved. In light of the flight performance, golf balls which are less likely to be spun have been demanded.

Golf balls hit with an ideal swing are not accompanied by side spin. However, the side spin is inevitable according to common swings. Golf players expect golf balls that are excellent in the directional stability. The golf balls follow a curved trajectory owing to the side spin. Also in light of the directional stability, golf balls that are less likely to be spun have been desired.

The golf players place great importance also on feel at impact of the golf balls. Golf players prefer soft feel at impact.

Japanese Unexamined Patent Application Publication No. Hei 7-24085 (U.S. Pat. No. 5,553,852) discloses a golf ball having a center, a mid layer and a cover. The specific gravity of this mid layer is smaller than the specific gravity of the center. In this type of golf ball, the mass distribution has a disproportionate pattern indicating greater weighing in the inner part. This golf ball will generate excessive spin.

Japanese Unexamined Patent Application Publication No. Hei 9-313643 (U.S. Pat. No. 5,830,085) discloses a golf ball having a core, a mid layer and a cover. The hardness of this mid layer is greater than the surface hardness of the core. This mid layer may deteriorate the feel at impact of the golf ball.

Japanese Unexamined Patent Application Publication No. Hei 11-253578 (U.S. Pat. No. 6,129,640) discloses a golf ball having a core, a mid layer and a cover. This mid layer includes polyurethane as a principal component. Such a mid layer may deteriorate the resilience performance of the golf ball. This golf ball is inferior in the flight performances.

Japanese Unexamined Patent Application Publication No. 2006-289059 (US2006/211517) discloses a golf ball having a core, a mid layer, a reinforcing layer and a cover. In this type of golf ball, the mass distribution has a disproportionate pattern indicating greater weighing in the inner part. This golf ball will generate excessive spin.

Japanese Unexamined Patent Application Publication No. 2006-289060 (US2006/211517) discloses a golf ball having a core, a mid layer, a reinforcing layer and a cover. In this type of golf ball, the mass distribution has a disproportionate pattern indicating greater weighing in the inner part. This golf ball will generate excessive spin.

Requirements for golf balls by golf players have been increasingly escalated. An object of the present invention is to provide a golf ball that is excellent in the flight performance, directional stability and feel at impact.

SUMMARY OF THE INVENTION

The golf ball according to the present invention has a center, a mid layer positioned outside this center, and a cover positioned outside this mid layer. The base polymer of this mid layer includes an ionomer resin as a principal component. The Shore D hardness H1*s* of the surface of the center is greater than the Shore D hardness H2 of the mid layer. The Shore D hardness H3 of the cover is equal to or greater than 57. The weight W2 of the mid layer is greater than the weight W3 of the cover. The total weight (W2+W3) of the weight W2 of the mid layer and the weight W3 of the cover is 8.4 g or greater and less than 12.0 g. The total volume (V2+V3) of the volume V2 of the mid layer and the volume V3 of the cover is equal to or less than 10.0 $cm^3$.

In the golf ball according to the present invention, the mass distribution has a disproportionate pattern indicating greater weighing in the outer part. This disproportion suppresses the back spin and the side spin. Due to a low back spin rate, a great flight distance of the golf ball can be achieved. Due to a low side spin rate, the variance of the flight direction of the golf ball is inhibited. In this golf ball, the mid layer is responsible for soft feel at impact.

Preferably, the mid layer has a thickness of 0.5 mm or greater and 1.2 mm or less, and the cover has a thickness of 0.3 mm or greater and 1.0 mm or less. Preferably, the mid layer includes a styrene block-containing thermoplastic elastomer. Preferably, the Shore D hardness H2 of the mid layer is 30 or greater and 50 or less. Preferably, the specific gravity G2 of the mid layer is equal to or greater than 1.20.

DESCRIPTION OF THE PREFERRED EMBODIMENTS

Figure 1:
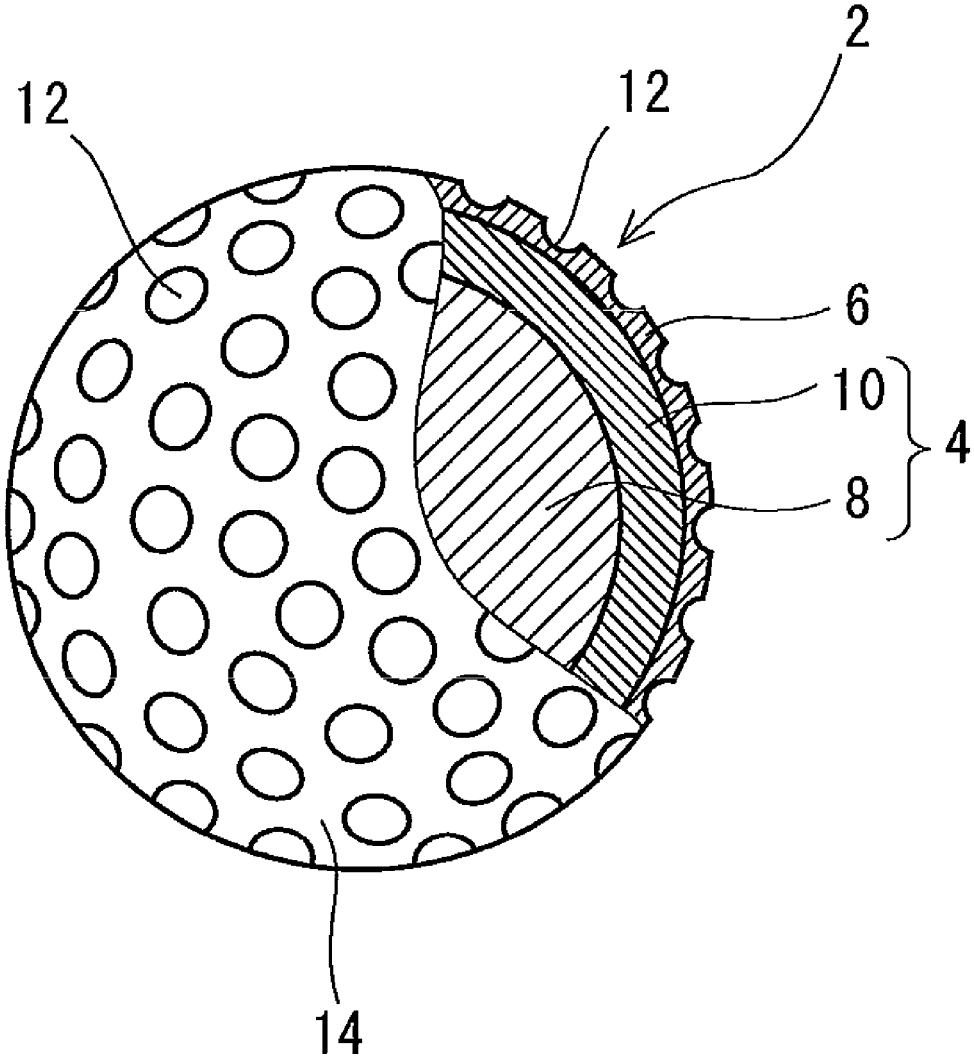
FIG. 1 shows a schematic cross-sectional view illustrating a golf ball according to one embodiment of the present invention.

Hereinafter, the present invention will be described in detail according to the preferred embodiments with appropriate references to the accompanying drawing.

Golf ball 2 shown in FIG. 1 has a spherical core 4 and a cover 6 positioned outside the core 4. The core 4 has a spherical center 8 and a mid layer 10 positioned outside the center 8. Numerous dimples 12 are formed on the surface of the cover 6. Of the surface of the golf ball 2, a part other than the dimples 12 is land 14. This golf ball 2 has a paint layer and a mark layer on the external side of the cover 6, although these layers are not shown in the FIGURE.

This golf ball 2 has a diameter of from 40 mm to 45 mm. From the standpoint of conformity to a rule defined by United States Golf Association (USGA), the diameter is preferably equal to or greater than 42.67 mm. In light of suppression of the air resistance, the diameter is preferably equal to or less than 44 mm, and more preferably equal to or less than 42.80 mm. The weight of this golf ball 2 is 40 g or greater and 50 g or less. In light of attainment of great inertia, the weight is preferably equal to or greater than 44 g, and more preferably equal to or greater than 45.00 g. From the standpoint of conformity to a rule defined by USGA, the weight is preferably equal to or less than 45.93 g.

Base polymer of the center 8 is a thermosetting polymer or a thermoplastic polymer. Preferably, the center 8 is obtained through crosslinking of a rubber composition. Illustrative examples of preferable base rubber include polybutadienes, polyisoprenes, styrene-butadiene copolymers, ethylene-propylene-diene copolymers and natural rubbers. In light of the resilience performance, polybutadienes are preferred. When other rubber is used in combination with polybutadiene, it is preferred that the polybutadiene be included as a principal component. Specifically, the proportion of polybutadiene based on the total amount of the base rubber is preferably equal to or greater than 50% by weight, and more preferably equal to or greater than 80% by weight. Polyurethane having a percentage of cis-1,4 bonds of equal to or greater than 40%, and particularly equal to or greater than 80% is preferred.

The rubber composition for use in the center 8 includes a co-crosslinking agent. The co-crosslinking agent serves in achieving high resilience of the center 8. Preferable examples of the co-crosslinking agent in light of the resilience performance include monovalent or bivalent metal salts of an α,β-unsaturated carboxylic acid having 2 to 8 carbon atoms. Specific examples of the preferable co-crosslinking agent include zinc acrylate, magnesium acrylate, zinc methacrylate and magnesium methacrylate. Zinc acrylate and zinc methacrylate are particularly preferred in light of the resilience performance.

As a co-crosslinking agent, an α,β-unsaturated carboxylic acid having 2 to 8 carbon atoms, and a metal oxide may be also blended. Both components react in the rubber composition to give a salt. This salt is responsible for the crosslinking reaction. Examples of preferable α,β-unsaturated carboxylic acid include acrylic acid and methacrylic acid. Examples of preferable metal oxide include zinc oxide and magnesium oxide.

In light of the resilience performance of the golf ball 2, the amount of the co-crosslinking agent is preferably equal to or greater than 10 parts by weight, and more preferably equal to or greater than 15 parts by weight per 100 parts by weight of the base rubber. In light of soft feel at impact, the amount of the co-crosslinking agent is preferably equal to or less than 50 parts by weight, and more preferably equal to or less than 45 parts by weight per 100 parts by weight of the base rubber.

Preferably, the rubber composition for use in the center 8 includes organic peroxide together with the co-crosslinking agent. The organic peroxide serves as a crosslinking initiator. The organic peroxide is responsible for the resilience performance of the golf ball 2. Examples of suitable organic peroxide include dicumyl peroxide, 1,1-bis(t-butylperoxy)-3,3,5-trimethylcyclohexane, 2,5-dimethyl-2,5-di(t-butylperoxy) hexane and di-t-butyl peroxide. In light of the versatility, dicumyl peroxide is preferred.

In light of the resilience performance of the golf ball 2, the amount of the organic peroxide is preferably equal to or greater than 0.1 parts by weight, more preferably equal to or greater than 0.3 parts by weight, and particularly preferably equal to or greater than 0.5 parts by weight per 100 parts by weight of the base rubber. In light of soft feel at impact, the amount of the organic peroxide is preferably equal to or less than 3.0 parts by weight, more preferably equal to or less than 2.8 parts by weight, and particularly preferably equal to or less than 2.5 parts by weight per 100 parts by weight of the base rubber.

Preferably, the rubber composition for use in the center 8 includes an organic sulfur compound. Illustrative examples of preferable organic sulfur compound include mono-substituted forms such as diphenyl disulfide, bis(4-chlorophenyl) disulfide, bis(3-chlorophenyl) disulfide, bis(4-bromophenyl) disulfide, bis(3-bromophenyl) disulfide, bis(4-fluorophenyl) disulfide, bis(4-iodophenyl) disulfide and bis(4-cyanophenyl) disulfide; di-substituted forms such as bis(2,5-dichlorophenyl) disulfide, bis(3,5-dichlorophenyl) disulfide, bis(2,6-dichlorophenyl) disulfide, bis(2,5-dibromophenyl) disulfide, bis(3,5-dibromophenyl) disulfide, bis(2-chloro-5-bromophenyl) disulfide and bis(2-cyano-5-bromophenyl) disulfide; tri-substituted forms such as bis(2,4,6-trichlorophenyl) disulfide and bis(2-cyano-4-chloro-6-bromophenyl) disulfide; tetra-substituted forms such as bis(2,3,5,6-tetrachlorophenyl) disulfide; and penta-substituted forms such as bis(2,3,4,5,6-pentachlorophenyl) disulfide and bis(2,3,4,5,6-pentabromophenyl) disulfide. The organic sulfur compound is responsible for the resilience performance. Particularly preferred organic sulfur compound is diphenyl disulfide and bis(pentabromophenyl) disulfide.

In light of the resilience performance of the golf ball 2, the amount of the organic sulfur compound is preferably equal to or greater than 0.1 parts by weight, and more preferably equal to or greater than 0.2 parts by weight per 100 parts by weight of the base rubber. In light of soft feel at impact, the amount of the organic sulfur compound is preferably equal to or less than 1.5 parts by weight, more preferably equal to or less than 1.0 parts by weight, and particularly preferably equal to or less than 0.8 parts by weight per 100 parts by weight of the base rubber.

Into the center 8 may be blended a filler for the purpose of adjusting specific gravity and the like. Illustrative examples of suitable filler include zinc oxide, barium sulfate, calcium carbonate and magnesium carbonate. The amount of the filler is determined ad libitum so that the intended specific gravity of the center 8 can be accomplished. Particularly preferable filler is zinc oxide. Zinc oxide serves not only to adjust the specific gravity but also as a crosslinking activator. Various kinds of additives such as an anti-aging agent, a coloring agent, a plasticizer, a dispersant and the like may be blended in an adequate amount to the center 8 as needed. Into the center 8 may be also blended crosslinked rubber powder or synthetic resin powder.

In light of the durability, the central hardness H1*c* of the center 8 is preferably equal to or greater than 25, more preferably equal to or greater than 30, and particularly preferably equal to or greater than 35. In light of suppression of the spin, the central hardness H1*c* is preferably equal to or less than 55, more preferably equal to or less than 50, and particularly preferably equal to or less than 45. The central hardness H1*c* is measured by pressing a Shore D type hardness scale at a central point of a hemisphere obtained by cutting the center 8. For the measurement, the automated rubber hardness scale (trade name "LA1", available from Koubunshi Keiki Co., Ltd.) which is equipped with this hardness scale is used.

In light of the resilience performance, surface hardness H1*s* of the center 8 is preferably equal to or greater than 35, more preferably equal to or greater than 40, and particularly preferably equal to or greater than 45. In light of the feel at impact, surface hardness H1*s* is preferably equal to or less than 65, more preferably equal to or less than 60, and particularly preferably equal to or less than 55. The surface hardness H1*s* is measured by pressing the Shore D type hardness scale against the surface of the center 8. For the measurement, the automated rubber hardness scale (trade name "LA1", available from Koubunshi Keiki Co., Ltd.) which is equipped with this hardness scale is used.

In light of suppression of the spin, the difference (H1*s*–H1*c*) between the surface hardness H1*s* and the central hardness H1*c* is preferably equal to or greater than 7, more preferably equal to or greater than 10, and particularly preferably equal to or greater than 13. In light of the durability of the golf ball 2, the difference (H1*s*–H1*c*) is preferably equal to or less than 25, more preferably equal to or less than 20, and particularly preferably equal to or less than 16.

The center 8 has a specific gravity G1 of preferably equal to or less than 1.18. This center 8 enables the mass distribution of the golf ball 2 to have a disproportionate pattern indicating greater weighing in the outer part. The spin may be suppressed owing to such disproportion. In this respect, the specific gravity G1 is more preferably equal to or less than 1.14, and particularly preferably equal to or less than 1.09. The specific gravity G1 is preferably equal to or greater than 1.00.

In light of the feel at impact, the amount of compressive deformation of the center 8 is preferably equal to or greater than 3.3 mm, more preferably equal to or greater than 3.5 mm, and particularly preferably equal to or greater than 3.8 mm. In light of the resilience performance, the amount of compressive deformation is preferably equal to or less than 7.0 mm, more preferably equal to or less than 5.0 mm, and particularly preferably equal to or less than 4.5 mm.

Upon measurement of the amount of compressive deformation, the spherical body (center 8, core 4 or golf ball 2) is placed on a hard plate made of metal. A cylinder made of metal gradually descends toward the spherical body. The spherical body intervened between the bottom face of the cylinder and the hard plate is deformed. A migration distance of the cylinder, starting from the state in which an initial load of 98 N is applied to the spherical body up to the state in which a final load of 1274 N is applied thereto is the amount of compressive deformation.

It is preferred that the center 8 has a diameter of equal to or greater than 39.1 mm. This center 8 enables the mid layer 10 to be positioned away from the central point. As described later, the mid layer 10 has a great specific gravity. By positioning the mid layer 10 having a great specific gravity to be away from the central point, the mass distribution of the golf ball 2 can have a disproportionate pattern indicating greater weighing in the outer part. The spin may be suppressed owing to such disproportion. In this respect, the diameter is more preferably equal to or greater than 39.3 mm, and particularly preferably equal to or greater than 39.5 mm. In light of capability of molding of the mid layer 10 having a sufficient thickness, the diameter is preferably equal to or less than 41 mm.

The weight W1 of the center 8 is preferably 32 g or greater and 39 g or less. The crosslinking temperature of the center 8 is usually 140° C. or greater and 180° C. or less. The crosslinking time period of the center 8 is usually 10 minutes or longer and 60 minutes or less. The center 8 may be formed with two or more layers. The center 8 may have a rib on the surface thereof.

For the mid layer 10, a resin composition is suitably used. Illustrative examples of the base polymer for use in the resin composition include ionomer resins, styrene block-containing thermoplastic elastomers, thermoplastic polyester elastomers, thermoplastic polyamide elastomers and thermoplastic polyolefin elastomers. In particular, ionomer resins are preferred. The ionomer resins are highly elastic. The golf ball 2 having the mid layer 10 formed using an ionomer resin is excellent in the resilience performance.

The ionomer resin and other resin may be used in combination. When they are used in combination, the ionomer resin is included as the principal component of the base polymer, in light of the resilience performance. The proportion of the amount of the ionomer resin based on the total amount of the base polymer is preferably equal to or greater than 50% by weight, more preferably equal to or greater than 60% by weight, and particularly preferably equal to or greater than 65%.

Examples of preferred ionomer resin include binary copolymers formed with α-olefin and an α,β-unsaturated carboxylic acid having 3 to 8 carbon atoms. Preferable binary copolymer comprises 80% by weight or more and 90% by weight or less α-olefin, and 10% by weight or more and 20% by weight or less α,β-unsaturated carboxylic acid. This binary copolymer provides excellent resilience performance. Examples of preferable other ionomer resin include ternary copolymers formed with α-olefin, an α,β-unsaturated carboxylic acid having 3 to 8 carbon atoms and an α,β-unsaturated carboxylate ester having 2 to 22 carbon atoms. Preferable ternary copolymer comprises 70% by weight or more and 85% by weight or less α-olefin, 5% by weight or more and 30% by weight or less α,β-unsaturated carboxylic acid, and 1% by weight or more and 25% by weight or less α,β-unsaturated carboxylate ester. This ternary copolymer provides excellent resilience performance. In the binary copolymer and ternary copolymer, preferable α-olefin is ethylene and propylene, and preferable α,β-unsaturated carboxylic acid is acrylic acid and methacrylic acid. Particularly preferred ionomer resin is a copolymer formed with ethylene, and acrylic acid or methacrylic acid.

In the binary copolymer and ternary copolymer, a part of the carboxyl groups may be neutralized with a metal ion. Illustrative examples of the metal ion for use in neutralization include sodium ion, potassium ion, lithium ion, zinc ion, calcium ion, magnesium ion, aluminum ion and neodymium ion. The neutralization may be carried out with two or more kinds of metal ions. Particularly suitable metal ion in light of the resilience performance and durability of the golf ball 2 is sodium ion, zinc ion, lithium ion and magnesium ion.

Specific examples of the ionomer resin include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7318", "Himilan AM7329", "Himilan MK7320" and "Himilan MK7329", available from Du Pont-MITSUI POLYCHEMICALS Co., Ltd.; trade names "Surlyn® 6120", "Surlyn® 6910", "Surlyn® 7930", "Surlyn® 7940", "Surlyn®8140", "Surlyn®8150", "Surlyn®8940", "Surlyn® 8945", "Surlyn®9120", "Surlyn®9150", "Surlyn®9910", "Surlyn® 9945", "Surlyn® AD8546", "HPF 1000" and "HPF 2000", available from Du Pont Kabushiki Kaisha; and trade names "IOTEK 7010", "IOTEK 7030", "IOTEK 7510", "IOTEK 7520", "IOTEK 8000" and "IOTEK 8030", available from EXXON Mobil Chemical Corporation.

Two or more kinds of the ionomer resins may be used in combination for the mid layer 10. An ionomer resin neutralized with a monovalent metal ion, and an ionomer resin neutralized with a bivalent metal ion may be used in combination.

Preferable resin which can be used in combination with the ionomer resin is the styrene block-containing thermoplastic elastomer. This elastomer is responsible for feel at impact of the golf ball 2. This elastomer does not deteriorate the resilience performance of the golf ball 2. This elastomer includes a polystyrene block as a hard segment, and a soft segment. Typical soft segment is a diene block. Illustrative examples of the compound for the diene block include butadiene, isoprene, 1,3-pentadiene and 2,3-dimethyl-1,3-butadiene. Butadiene and isoprene are preferred. Two or more compounds may be used in combination.

The styrene block-containing thermoplastic elastomer may include a styrene-butadiene-styrene block copolymer (SBS), a styrene-isoprene-styrene block copolymer (SIS), a styrene-isoprene-butadiene-styrene block copolymer (SIBS), a hydrogenated product of SBS, a hydrogenated product of SIS or a hydrogenated product of SIBS. Exemplary hydrogenated product of SBS is a styrene-ethylene-butylene-styrene block copolymer (SEBS). Exemplary hydrogenated product of SIS is a styrene-ethylene-propylene-styrene block copolymer (SEPS). Exemplary hydrogenated product of SIBS is a styrene-ethylene-ethylene-propylene-styrene block copolymer (SEEPS).

In light of the resilience performance of the golf ball 2, the content of styrene component in the thermoplastic elastomer is preferably equal to or greater than 10% by weight, more preferably equal to or greater than 12% by weight, and particularly preferably equal to or greater than 15% by weight. In light of the feel at impact of the golf ball 2, the content is preferably equal to or less than 50% by weight, more preferably equal to or less than 47% by weight, and particularly preferably equal to or less than 45% by weight.

In the present invention, the styrene block-containing thermoplastic elastomer includes an alloy of olefin with one or more selected from the group consisting of SBS, SIS, SIBS, SEBS, SEPS and SEEPS, and hydrogenated products thereof. The olefin component in this alloy is speculated to contribute to improvement of the compatibility with the ionomer resin. When this alloy is used, the resilience performance of the golf ball 2 is improved. Preferably, olefin having 2 to 10 carbon atoms may be used. Illustrative examples of suitable olefin include ethylene, propylene, butene and pentene. Ethylene and propylene are particularly preferred.

Specific examples of the polymer alloy include trade names "Rabalon® T3221C", "Rabalon® T3339C", "Rabalon® SJ4400N", "Rabalon® SJ5400N", "Rabalon® SJ6400N", "Rabalon® SJ7400N", "Rabalon® SJ8400N", "Rabalon® SJ9400N" and "Rabalon® SR04", available from Mitsubishi Chemical Corporation. Other specific examples of the styrene block-containing thermoplastic elastomer include trade name "Epofriend®A1010", available from Daicel Chemical Industries; and trade name "Septon HG-252", available from Kuraray Co., Ltd.

When the ionomer resin and the styrene block-containing thermoplastic elastomer are used in combination for the mid layer 10, the weight ratio of both is preferably 50/50 or greater and 95/5 or less. The mid layer 10 having this ratio of equal to or greater than 50/50 is responsible for the resilience performance of the golf ball 2. In this respect, the ratio is more preferably equal to or greater than 55/45, and particularly preferably equal to or greater than 60/40. The mid layer 10 having this ratio of equal to or less than 95/5 is responsible for the feel at impact of the golf ball 2. In this respect, the ratio is more preferably equal to or less than 80/20, and particularly preferably equal to or less than 70/30.

Preferably, the mid layer 10 includes the powder of a metal having a high specific gravity. This powder serves in achieving high specific gravity of the mid layer 10. This powder may serve in allowing the mass distribution of the golf ball 2 to have a disproportionate pattern indicating greater weighing in the outer part. The spin may be suppressed owing to such disproportion. Typical metals having a high specific gravity include tungsten and molybdenum. The amount of the powder of the metal having a high specific gravity is preferably equal to or greater than 20 parts by weight, more preferably equal to or greater than 32 parts by weight, and particularly preferably equal to or greater than 45 parts by weight per 100 parts by weight of the base polymer of the mid layer 10. In light of ease in molding of the mid layer 10, the amount of the powder is preferably equal to or less than 60 parts by weight.

Into the mid layer 10 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. For formation of the mid layer 10, any known process such as injection molding or compression molding may be employed.

In light of the resilience performance, the hardness H2 of the mid layer 10 is preferably equal to or greater than 30, more preferably equal to or greater than 35, and particularly preferably equal to or greater than 40. In light of the feel at impact, the hardness H2 is preferably equal to or less than 50, and more preferably equal to or less than 47. The hardness H2 may be measured in accordance with a standard of "ASTM-D 2240-68" by using a Shore D type hardness scale attached to an automated rubber hardness measuring device (trade name "LA1", available from Koubunshi Keiki Co., Ltd.). For the measurement, a slab formed by hot pressing to have a thickness of about 2 mm is used. The slab which has been stored at a temperature of 23° C. for two weeks is used for the measurement. When the measurement is carried out, three pieces of the slab are overlaid. A slab constituted with a resin composition that is the same as the resin composition of the mid layer 10 is used in the measurement.

The mid layer 10 has a specific gravity G2 of preferably equal to or greater than 1.20. This mid layer 10 may serve in allowing the mass distribution of the golf ball 2 to have a disproportionate pattern indicating greater weighing in the outer part. The spin may be suppressed owing to such disproportion. In this respect, the specific gravity G2 is more preferably equal to or greater than 1.25, and particularly preferably equal to or greater than 1.30. The specific gravity G2 is preferably equal to or less than 2.0.

In light of the possibility that the mass distribution of the golf ball 2 can have a disproportionate pattern indicating greater weighing in the outer part the mid layer 10 has a thickness of preferably equal to or greater than 0.5 mm, more preferably equal to or greater than 0.7 mm, and particularly preferably equal to or greater than 0.8 mm. In light of possible formation of the center 8 having a sufficient diameter, the thickness is preferably equal to or less than 1.2 mm, and more preferably equal to or less than 1.0 mm.

In light of the possibility that the mass distribution of the golf ball 2 can have a disproportionate pattern indicating greater weighing in the outer part, the mid layer 10 has a volume V2 of preferably equal to or greater than 3.5 $cm^3$, more preferably equal to or greater than 3.8 $cm^3$, and particularly preferably equal to or greater than 4.1 $cm^3$. In light of the possibility that the center 8 having a sufficient diameter can be provided, the volume V2 is preferably equal to or less than 5 $cm^3$.

In light of the possibility that the mass distribution of the golf ball 2 can have a disproportionate pattern indicating greater weighing in the outer part, the mid layer 10 has a weight W2 of preferably equal to or greater than 5.0 g, more preferably equal to or greater than 5.2 g, and particularly preferably equal to or greater than 5.5 g. In light of the possibility that the center 8 having a sufficient diameter can be provided, the weight W2 is preferably equal to or less than 7 g.

As described above, the core 4 is constituted with the center 8 and the mid layer 10. In light of the possibility that the mass distribution of the golf ball 2 can have a disproportionate pattern indicating greater weighing in the outer part, the core 4 has a diameter of preferably equal to or greater than 40.7 mm, more preferably equal to or greater than 40.9 mm, and particularly preferably equal to or greater than 41.1 mm. The diameter is preferably equal to or less than 42.2 mm.

In light of the feel at impact, the amount of compressive deformation of the core 4 is preferably equal to or greater than 3.2 mm, more preferably equal to or greater than 3.4 mm, and particularly preferably equal to or greater than 3.7 mm. In light of the resilience performance, the amount of compressive deformation is preferably equal to or less than 6.5 mm, more preferably equal to or less than 4.8 mm, and particularly preferably equal to or less than 4.3 mm.

A resin composition is suitably used for the cover 6. Illustrative examples of the base polymer for use in this resin composition include ionomer resins, styrene block-containing thermoplastic elastomers, thermoplastic polyester elastomers, thermoplastic polyamide elastomers and thermoplastic polyolefin elastomers. In particular, ionomer resins are preferred. The ionomer resins are highly elastic. The golf ball 2 having the cover 6 formed using an ionomer resin is excellent in the resilience performance. The ionomer resin as described above in connection with the mid layer 10 can be used for the cover 6.

The ionomer resin and other resin may be used in combination. When they are used in combination, the ionomer resin is included as the principal component of the base polymer, in light of the resilience performance. The proportion of the amount of the ionomer resin based on the total amount of the base polymer is preferably equal to or greater than 50% by weight, more preferably equal to or greater than 70% by weight, and particularly preferably equal to or greater than 85%.

Preferable resin which can be used in combination with the ionomer resin is a styrene block-containing thermoplastic elastomer. The styrene block-containing thermoplastic elastomer described above in connection with the mid layer 10 can be used for cover 6.

When the ionomer resin and the styrene block-containing thermoplastic elastomer are used in combination for the cover 6, the weight ratio of both is preferably equal to or greater than 60/40. The cover 6 having this ratio of equal to or greater than 60/40 is responsible for the resilience performance of the golf ball 2. In this respect, the ratio is more preferably equal to or greater than 75/25, and particularly preferably equal to or greater than 85/15. In light of the feel at impact, the ratio is preferably equal to or less than 98/2.

Into the cover 6 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. For formation of the cover 6, any known process such as injection molding or compression molding may be employed. When the cover 6 is molded, dimples 12 are formed by means of a large number of pimples formed on the cavity face of the mold.

In light of suppression of the spin, the hardness H3 of the cover 6 is preferably equal to or greater than 57, more preferably equal to or greater than 59, and particularly preferably equal to or greater than 61. In light of the feel at impact, the hardness H3 is preferably equal to or less than 66, and more preferably equal to or less than 64. The hardness H3 may be measured in accordance with a standard of "ASTM-D 2240-68" by using a Shore D type hardness scale attached to an automated rubber hardness measuring device (trade name "LA1", available from Koubunshi Keiki Co., Ltd.). For the measurement, a slab formed by hot pressing to have a thickness of about 2 mm is used. The slab which has been stored at a temperature of 23° C. for two weeks is used for the measurement. When the measurement is carried out, three pieces of the slab are overlaid. A slab constituted with a resin composition that is the same as the resin composition of the cover 6 is used in the measurement.

In light of suppression of the spin, the cover 6 has a specific gravity G3 of preferably equal to or greater than 0.97, and more preferably equal to or greater than 1.00. In light of the formability of the cover 6, the specific gravity G3 is preferably equal to or less than 1.20, and more preferably equal to or less than 1.15.

In light of ease in molding of the cover 6, this cover 6 has a thickness of preferably equal to or greater than 0.3 mm, and more preferably equal to or greater than 0.4 mm. In light of the possibility that the mid layer 10 can have a disproportionate pattern indicating greater weighing in the outer part, the thickness is preferably equal to or less than 1.0 mm, more preferably equal to or less than 0.9 mm, and particularly preferably equal to or less than 0.8 mm.

In light of the durability of the golf ball 2, the cover 6 has a volume V3 of equal to or greater than 3.2 $cm^3$, and more preferably equal to or greater than 4.0 $cm^3$. In light of the possibility that the mid layer 10 having a sufficient thickness can be provided, the volume V3 is preferably equal to or less than 6.2 $cm^3$, and more preferably equal to or less than 5.2 $cm^3$.

In light of the durability of the golf ball 2, the cover 6 has a weight W3 of preferably equal to or greater than 3.0 g, and more preferably equal to or greater than 4.0 g. In light of the possibility that the mid layer 10 having a sufficient thickness can be provided, the weight W3 is preferably equal to or less than 6.0 g, and more preferably equal to or less than 5.0 g.

In light of the feel at impact, the amount of compressive deformation of the golf ball 2 is preferably equal to or greater than 2.5 mm, more preferably equal to or greater than 2.7 mm, and particularly preferably equal to or greater than 2.9 mm. In light of the resilience performance, the amount of compressive deformation is preferably equal to or less than 3.8 mm, more preferably equal to or less than 3.5 mm, and particularly preferably equal to or less than 3.4 mm.

In this golf ball 2, the surface hardness H1*s* of the center 8 is greater than the hardness H2 of the mid layer 10. The mid layer 10 is positioned outside the center 8. When this golf ball 2 is hit by a golf player who attains a comparatively low head speed, the mid layer 10 has a greater influence on the feel at impact than the center 8. Resulting from the small hardness H2 of the mid layer 10, soft feel at impact is experienced with this golf ball 2. In light of the feel at impact, the difference (H1*s*−H2) is preferably equal to or greater than 2, more preferably equal to or greater than 4, and particularly preferably equal to or greater than 8. The difference (H1*s*−H2) is preferably equal to or less than 15.

In this golf ball 2, the weight W2 of the mid layer 10 is greater than the weight W3 of the cover 6. This means that the mid layer 10 has a sufficiently great specific gravity G2, and the cover 6 has a thickness small enough. In this golf ball 2, the mass distribution has a disproportionate pattern indicating greater weighing in the outer part. Suppression of the back spin and the side spin can be achieved in this golf ball 2. Due to a small back spin rate, a great flight distance of the golf ball 2 can be attained. Due to a small side spin rate, variation in the flight direction of the golf ball 2 can be avoided. In this respect, the difference (W2−W3) is preferably equal to or greater than 0.5 g, more preferably equal to or greater than 0.8 g, and particularly preferably equal to or greater than 1.1 g. The difference (W2−W3) is preferably equal to or less than 3 g.

The total weight (W2+W3) of the weight W2 of the mid layer 10 and the weight W3 of the cover 6 is greater than 8.4 g and less than 12.0 g. In the golf ball 2 having the total weight (W2+W3) of greater than 8.4 g, the part other than the center 8 has satisfactory rigidity. The spin can be suppressed by the satisfactory constitution. In this respect, the total weight (W2+W3) is more preferably equal to or greater than 8.6 g, and particularly preferably equal to or greater than 9.0 g. In the golf ball 2 having the total weight (W2+W3) of equal to or less than 12.0 g, the center 8 having a sufficient diameter can be formed. This center 8 is responsible for the resilience performance. In this respect, the total weight (W2+W3) is more preferably equal to or less than 11.5 g, and particularly preferably equal to or less than 11.0 g.

The total volume (V2+V3) of the volume V2 of the mid layer 10 and the volume V3 of the cover 6 is equal to or less than 10.0 $cm^3$. In the golf ball 2 having the total volume (V2+V3) of equal to or less than 10.0 $cm^3$, the mass distribution can have a disproportionate pattern indicating greater weighing in the outer part. This disproportion suppresses the back spin and the side spin. In this respect, the total volume (V2+V3) is preferably equal to or less than 9.8 $cm^3$, and more preferably equal to or less than 9.5 $cm^3$. The total volume (V2+V3) is preferably equal to or greater than 6.7 $cm^3$.

In light of the possibility that the mass distribution can have a disproportionate pattern indicating greater weighing in the outer part, the difference (G2−G1) between the specific gravity G2 of the mid layer 10 and the specific gravity G1 of the center 8 is preferably equal to or greater than 0.01, more preferably equal to or greater than 0.03, and particularly preferably equal to or greater than 0.05. The difference (G2−G1) is preferably equal to or less than 0.20.

EXAMPLES

Example 1

A rubber composition (i) was obtained by kneading 100 parts by weight of high-cis polybutadiene (trade name "BR-730", available from JSR Corporation), 28.0 parts by weight of zinc diacrylate, 10 parts by weight of zinc oxide, 12.7 parts by weight of barium sulfate, 0.5 parts by weight of diphenyl disulfide (Sumitomo Seika Chemicals Co., Ltd.) and 0.9 parts by weight of dicumyl peroxide (NOF Corporation). This rubber composition (i) was placed into a mold having upper and lower mold half each having a hemispherical cavity, and heated to obtain a center. This center had a diameter of 39.6 mm.

A resin composition (b) was obtained by kneading 35 parts by weight of an ionomer resin (the aforementioned "Surlyn® 8945"), 30 parts by weight of other ionomer resin (the aforementioned "Himilan AM7329"), 35 parts by weight of a styrene block-containing thermoplastic elastomer (the aforementioned "Rabalon® T3221C") and 32 parts by weight of tungsten powder in a biaxial kneading extruder. The center was placed into a mold having upper and lower mold half each having a hemispherical cavity. The resin composition (b) was injected around the center by injection molding to form a mid layer. This mid layer had a thickness of 0.8 mm.

A resin composition (h) was obtained by kneading 58 parts by weight of an ionomer resin (the aforementioned "Surlyn® 8945"), 40 parts by weight of other ionomer resin (the aforementioned "Himilan AM7329"), 2 parts by weight of a styrene block-containing thermoplastic elastomer (the aforementioned "Rabalon® T3221C"), 3 parts by weight of titanium dioxide and 0.04 parts by weight of Ultramarine blue in a biaxial kneading extruder. The core was placed into a final mold having upper and lower mold half each having a hemispherical cavity, and having pimples on the cavity face thereof. The resin composition (h) was injected around the core by injection molding to form a cover. This cover had a thickness of 1.6 mm. Numerous dimples having a shape inverted from the shape of the pimple were formed on the cover. A clear paint including a two-part liquid curable polyurethane as a base was applied on this cover to give a golf ball of Example 1 having a diameter of 42.8 mm and a weight of about 45.6 g.

Examples 2 to 6 and Comparative Examples 1 to 6

Golf balls of Examples 2 to 6 and Comparative Examples 1 to 6 were obtained in a similar manner to Example 1 except that specifications of the center, the mid layer and the cover were as listed in Tables 3 to 5 below. Details of the rubber composition of the center are presented in Table 1 below. Details of the resin compositions of the mid layer and the cover are presented in Table 2 below.

Evaluation of Flight Distance

A driver with a titanium head (trade name "XXIO", available from SRI Sports Limited, shaft hardness: S, loft angle: 10.00) was attached to a swing machine, available from True Temper Co. The golf ball was hit under the condition to provide a head speed of 45 m/sec. Accordingly, the distance from the launching point to the point where the ball stopped was measured. Mean values of data obtained by the measurement of 10 times are presented in Tables 3 to 5 below.

Evaluation of Directional Stability

A driver with a titanium head (trade name "XXIO", available from SRI Sports Limited, shaft hardness: S, loft angle: 10.00) was attached to a swing machine, available from True Temper Co. such that the face is opened at a degree of 2°. The golf ball was hit under the condition to provide a head speed of 45 m/sec. Accordingly, the distance between the point where the ball stopped and the line oriented to the target was measured. The measurement was carried out ten times, and the first mean value was determined. The aforementioned driver was attached such that the face is closed at a degree of 20. The golf ball was hit under the condition to provide a head speed of 45 m/sec. Accordingly, the distance between the point where the ball stopped and the line oriented to the target was measured. The measurement was carried out ten times, and the second mean value was determined. The total values of the first mean value and the second mean value (i.e., range) are shown in Tables 3 to 5 below.

Evaluation of Feel at Impact

Using a driver, the golf balls were hit by a golf player. Then, rating of the feel at impact was conducted based on the following criteria:

A: soft
B: slightly soft
C: slightly hard
D: hard

TABLE 1

Composition of Center (parts by weight)

| | i | ii | iii | iv | v | vi | vii | viii | ix | x | xi |
|---|---|---|---|---|---|---|---|---|---|---|---|
| Polybutadiene | 100 | 100 | 100 | 100 | 100 | 100 | 100 | 100 | 100 | 100 | 100 |
| Zinc diacrylate | 28.0 | 28.0 | 28.0 | 28.0 | 28.0 | 28.0 | 28.0 | 27.0 | 27.0 | 27.0 | 26.5 |
| Zinc oxide | 10 | 10 | 10 | 10 | 10 | 10 | 10 | 10 | 10 | 10 | 10 |

TABLE 1-continued

| Composition of Center | | | | | | | | | | | |
|---|---|---|---|---|---|---|---|---|---|---|---|
| | | | | | | | | | | | (parts by weight) |
| | i | ii | iii | iv | v | vi | vii | viii | ix | x | xi |
| Barium sulfate | 12.7 | 6.3 | 5.2 | 4.0 | 6.6 | 4.9 | 5.7 | 6.5 | 8.6 | 6.8 | 6.9 |
| Diphenyl disulfide | 0.5 | 0.5 | 0.5 | 0.5 | 0.5 | 0.5 | 0.5 | 0.5 | 0.5 | 0.5 | 0.5 |
| Dicumyl peroxide | 0.9 | 0.9 | 0.9 | 0.9 | 0.9 | 0.9 | 0.9 | 0.9 | 0.9 | 0.9 | 0.9 |
| Crosslinking temperature (° C.) | 170 | 170 | 170 | 170 | 170 | 170 | 170 | 170 | 170 | 170 | 150 |
| Crosslinking time (min) | 20 | 20 | 20 | 20 | 20 | 20 | 20 | 20 | 20 | 20 | 40 |

TABLE 2

| Resin Composition of Mid Layer and Cover | | | | | | | | | |
|---|---|---|---|---|---|---|---|---|---|
| | | | | | | | | | (parts by weight) |
| | a | b | c | d | e | f | g | h | i |
| Surlyn ® 8945 *1 | 35 | 35 | 35 | 35 | 48 | 40 | — | 58 | 45 |
| Himilan AM7329 *2 | 30 | 30 | 30 | 30 | 30 | 30 | — | 40 | 40 |
| Rabalon ® T3221C *3 | 35 | 35 | 35 | 35 | 22 | 30 | — | 2 | 15 |
| Elastolan XNY90A *4 | — | — | — | — | — | — | 30 | — | — |
| Elastolan XNY97A *5 | — | — | — | — | — | — | 70 | — | — |
| Titanium dioxide | — | — | — | — | — | — | — | 3 | 3 |
| Tungsten | — | 32 | 38 | 45 | 32 | 32 | 14 | — | — |
| Ultramarine blue | — | — | — | — | — | — | — | 0.04 | 0.04 |
| Hardness (Shore D) | 44 | 44 | 44 | 44 | 53 | 48 | 44 | 63 | 56 |
| Specific gravity | 0.94 | 1.22 | 1.27 | 1.33 | 1.23 | 1.22 | 1.22 | 0.98 | 0.97 |

*1: ethylene-methacrylic ionomer resin neutralized with sodium ion (Du Pont Kabushiki Kaisha)

*2: ethylene-methacrylic ionomer resin neutralized with zinc ion (Du Pont-MITSUI POLYCHEMICALS Co., Ltd.)

*3: styrene block-containing thermoplastic elastomer (Mitsubishi Chemical Corporation)

*4: thermoplastic polyurethane elastomer (BASF Japan Ltd.,)

*5: thermoplastic polyurethane elastomer (BASF Japan Ltd.,)

TABLE 3

| Evaluation Results | | | | | |
|---|---|---|---|---|---|
| | | Compa. example 1 | Example 1 | Example 2 | Example 3 |
| Center | Composition | i | ii | iii | iv |
| | Diameter (mm) | 39.6 | 39.6 | 39.6 | 39.6 |
| | Central hardness H1c (D) | 39 | 39 | 39 | 39 |
| | Surface hardness H1s (D) | 52 | 52 | 52 | 52 |
| | Specific gravity G1 | 1.151 | 1.151 | 1.109 | 1.102 |
| Mid layer | Composition | a | b | c | d |
| | Hardness H2 (D) | 44 | 44 | 44 | 44 |
| | Thickness (mm) | 0.8 | 0.8 | 0.8 | 0.8 |
| | Volume V2 ($cm^3$) | 4.10 | 4.10 | 4.10 | 4.10 |
| | Specific gravity G2 | 0.94 | 1.22 | 1.27 | 1.33 |
| | Weight W2 (g) | 3.86 | 5.01 | 5.21 | 5.46 |
| Core | Diameter (mm) | 41.2 | 41.2 | 41.2 | 41.2 |
| Cover | Composition | h | h | h | h |
| | Hardness H3 (D) | 63 | 63 | 63 | 63 |
| | Thickness (mm) | 0.8 | 0.8 | 0.8 | 0.8 |
| | Volume V3 ($cm^3$) | 4.43 | 4.43 | 4.43 | 4.43 |
| | Specific gravity G3 | 0.98 | 0.98 | 0.98 | 0.98 |
| | Weight W3 (g) | 4.35 | 4.35 | 4.35 | 4.35 |
| Ball | Compressive deformation (mm) | 3.2 | 3.2 | 3.2 | 3.2 |
| | H1s − H2 (D) | 8 | 8 | 8 | 8 |
| | W2 − W3 (g) | −0.49 | 0.66 | 0.86 | 1.11 |
| | W2 + W3 (g) | 8.21 | 9.36 | 9.56 | 9.81 |
| | V2 + V3 ($cm^3$) | 8.53 | 8.53 | 8.53 | 8.53 |
| Flight distance (m) | | 226 | 234 | 236 | 238 |
| Range (m) | | 8.4 | 4.4 | 4.1 | 3.2 |
| Feel at impact | | A | A | A | A |

TABLE 4

| Evaluation Results | | | | | |
|---|---|---|---|---|---|
| | | Compa. example 2 | Example 4 | Compa. example 3 | Compa. example 4 |
| Center | Composition | viii | ii | ii | ix |
| | Diameter (mm) | 39.6 | 39.6 | 39.6 | 38.4 |
| | Central hardness H1c (D) | 38 | 39 | 39 | 38 |
| | Surface hardness H1s (D) | 51 | 52 | 52 | 51 |
| | Specific gravity G1 | 1.114 | 1.115 | 1.115 | 1.126 |
| Mid layer | Composition | e | f | g | b |
| | Hardness H2 (D) | 53 | 48 | 44 | 44 |
| | Thickness (mm) | 0.8 | 0.8 | 0.8 | 0.9 |
| | Volume V2 ($cm^3$) | 4.10 | 4.10 | 4.10 | 4.37 |
| | Specific gravity G2 | 1.23 | 1.22 | 1.22 | 1.22 |
| | Weight W2 (g) | 5.05 | 5.01 | 5.01 | 5.33 |
| Core | Diameter (mm) | 41.2 | 41.2 | 41.2 | 40.2 |
| Cover | Composition | h | h | h | h |
| | Hardness H3 (D) | 63 | 63 | 63 | 63 |
| | Thickness (mm) | 0.8 | 0.8 | 0.8 | 1.3 |
| | Volume V3 ($cm^3$) | 4.43 | 4.43 | 4.43 | 7.04 |
| | Specific gravity G3 | 0.98 | 0.98 | 0.98 | 0.98 |
| | Weight W3 (g) | 4.35 | 4.35 | 4.35 | 6.90 |
| Ball | Compressive deformation (mm) | 3.2 | 3.1 | 3.2 | 3.1 |
| | H1s − H2 (D) | −2 | 4 | 8 | 7 |
| | W2 − W3 (g) | 0.70 | 0.66 | 0.66 | −1.57 |
| | W2 + W3 (g) | 9.40 | 9.36 | 9.36 | 12.23 |
| | V2 + V3 ($cm^3$) | 8.53 | 8.53 | 8.53 | 11.41 |
| Flight distance (m) | | 232 | 233 | 222 | 226 |
| Range (m) | | 4.3 | 4.2 | 4.2 | 4.1 |
| Feel at impact | | D | B | A | C |

TABLE 5

| Evaluation Results | | | | | | |
|---|---|---|---|---|---|---|
| | | Example 5 | Example 6 | Compa. example 5 | Compa. example 6 | Example 7 |
| Center | Composition | x | xi | v | vi | vii |
| | Diameter (mm) | 39.2 | 39.6 | 39.6 | 38.6 | 39.2 |
| | Central hardness H1c (D) | 38 | 44 | 39 | 39 | 38 |
| | Surface hardness H1s (D) | 51 | 48 | 52 | 52 | 51 |
| | Specific gravity G1 | 1.116 | 1.115 | 1.117 | 1.107 | 1.112 |
| Mid layer | Composition | b | b | b | b | b |
| | Hardness H2 (D) | 44 | 44 | 44 | 44 | 44 |
| | Thickness (mm) | 0.9 | 0.8 | 0.8 | 1.3 | 1.0 |
| | Volume V2 ($cm^3$) | 4.55 | 4.10 | 4.10 | 6.50 | 5.08 |
| | Specific gravity G2 | 1.22 | 1.22 | 1.22 | 1.22 | 1.22 |
| | Weight W2 (g) | 5.55 | 5.01 | 5.01 | 7.94 | 6.20 |
| Core | Diameter (mm) | 41.0 | 41.2 | 41.2 | 41.2 | 41.2 |
| Cover | Composition | h | h | i | h | h |
| | Hardness H3 (D) | 63 | 63 | 56 | 63 | 63 |
| | Thickness (mm) | 0.9 | 0.8 | 0.8 | 0.8 | 0.8 |
| | Volume V3 ($cm^3$) | 4.96 | 4.43 | 4.43 | 4.43 | 4.43 |
| | Specific gravity G3 | 0.98 | 0.98 | 0.97 | 0.98 | 0.98 |
| | Weight W3 (g) | 4.87 | 4.35 | 4.30 | 4.35 | 4.35 |
| Ball | Compressive deformation (mm) | 3.2 | 3.2 | 3.3 | 3.0 | 3.2 |
| | H1s − H2 (D) | 7 | 4 | 8 | 8 | 7 |
| | W2 − W3 (g) | 0.68 | 0.66 | 0.71 | 3.59 | 1.85 |
| | W2 + W3 (g) | 10.42 | 9.36 | 9.31 | 12.29 | 10.55 |
| | V2 + V3 ($cm^3$) | 9.51 | 8.53 | 8.53 | 10.93 | 9.51 |
| Flight distance (m) | | 232 | 232 | 232 | 228 | 233 |
| Range (m) | | 4.4 | 4.2 | 6.5 | 4.6 | 4.5 |
| Feel at impact | | A | B | A | A | A |

As shown in Tables 3 to 5, the golf ball of each Example is excellent in various performances. Therefore, advantages of the present invention are clearly suggested by these results of evaluation.

The golf ball according to the present invention can be used for the play at golf courses, and the practice in the driving range. The foregoing description is just for illustrative examples, therefore, various modifications can be made in the scope without departing from the principles of the present invention.

What is claimed is:

1. A golf ball which comprises a center, a mid layer positioned outside the center, and a cover positioned outside the mid layer, the base polymer of the mid layer including an ionomer resin as a principal component, the Shore D hardness H1*s* of the surface of the center being greater than the Shore D hardness H2 of the mid layer, the Shore D hardness H3 of the cover being equal to or greater than 57, the weight W2 of the mid layer being greater than the weight W3 of the cover, the total weight (W2+W3) of the weight W2 of the mid layer and the weight W3 of the cover being 8.4 g or greater and less than 12.0 g, the total volume (V2+V3) of the volume V2 of the mid layer and the volume V3 of the cover being equal to or less than 10.0 $cm^3$, and wherein the difference (G2−G1) between the specific gravity G2 of the mid layer and the specific gravity G1 of the center is equal to or greater than 0.01.

2. The golf ball according to claim 1 wherein the mid layer has a thickness of 0.5 mm or greater and 1.2 mm or less; and the cover has a thickness of 0.3 mm or greater and 1.0 mm or less.

3. The golf ball according to claim 1 wherein the mid layer includes a styrene block-containing thermoplastic elastomer.

4. The golf ball according to claim 1 wherein the Shore D hardness H2 of the mid layer is 30 or greater and 50 or less.

5. The golf ball according to claim 1 wherein the specific gravity G2 of the mid layer is equal to or greater than 1.20.

6. The golf ball according to claim 1 wherein the difference (H1*s*−H2) of the surface hardness H1*s* of the center and the hardness H2 of the mid layer is equal to or greater than 4.

7. The golf ball according to claim 1 wherein the difference (W2−W3) of the weight W2 of the mid layer and the weight of cover W3 is equal to or greater than 0.66 g and equal to or less than 1.85 g.

8. The golf ball according to claim 1 wherein the difference (G2−G1) between the specific gravity G2 of the mid layer and the specific gravity G1 of the center is equal to or greater than 0.03 and equal to or less than 0.20.

* * * * *